US005299355A

United States Patent [19]

Boda et al.

[11] Patent Number: 5,299,355

[45] Date of Patent: Apr. 5, 1994

[54] ROTARY BLADE ACTUATOR FOR A HAND HELD CUTTER

[75] Inventors: James C. Boda, Winneconne; Stephen A. Peterson, Eland, both of Wis.

[73] Assignee: Fiskars Oy Ab, Helsinki, Finland

[21] Appl. No.: 977,502

[22] Filed: Nov. 16, 1992

[51] Int. Cl.[5] ..... B26B 3/06; B26B 29/00

[52] U.S. Cl. ..... 30/162; 30/292

[58] Field of Search ..... 30/162, 124, 292, 307, 30/319, 377, 294

[56] References Cited

U.S. PATENT DOCUMENTS

| | | | |
|---|---|---|---|
| 1,306,783 | 6/1919 | Smolinsky . | |
| 2,568,353 | 9/1951 | Miseta, Jr. . | |
| 3,802,080 | 4/1974 | Peter | 30/292 |
| 4,020,550 | 5/1977 | Okada | 30/292 |
| 4,301,594 | 11/1981 | Okada | 30/292 |
| 4,432,137 | 2/1984 | Okada | 30/292 |
| 4,601,103 | 7/1986 | Sugiyama | 30/292 |
| 4,809,437 | 3/1989 | Saliaris . | |
| 5,101,564 | 4/1992 | Melter | 30/292 |
| 5,144,749 | 9/1992 | Chen | 30/292 |

*Primary Examiner*—Richard K. Seidel
*Assistant Examiner*—Paul M. Heyrana
*Attorney, Agent, or Firm*—Foley & Lardner

[57] ABSTRACT

A rotary cutter including a handle, a cylindrical head formed on one end of the handle and having a planar surface on each side, the handle and head having an internal cavity, a unitary actuating member mounted in the cavity in the handle and head, a circular blade supported by the actuating member for movement between a storage position and an operating position with respect to one of the planar surfaces, the actuating member including a spring for biasing the blade to the storage position, and a resilient latch for locking the actuating member in the operative position.

11 Claims, 3 Drawing Sheets

ROTARY BLADE ACTUATOR FOR A HAND HELD CUTTER

FIELD OF THE INVENTION

The present invention relates to hand held rotary cutters and more particularly to a one piece actuator for moving a rotary cutter blade between operative and inoperative positions with respect to the handle.

BACKGROUND OF THE INVENTION

Hand held rotary cutters of the type contemplated herein are shown in U.S. Pat. No. 5,101,564, entitled "Hand Held Cutter Having A Rotatable Circular Blade And Safety Guard," issued on Apr. 7, 1992, to Craig H. Melter, and U.S. patent application Ser. No. 07/944,870, entitled "Rotary Cutting Blade Assembly For A Hand Held Cutter," filed on Sep. 14, 1992. Each of these prior art references describe rotary cutters wherein the blade is moved along an arcuate path relative to the handle to selectively expose and retract the cutting perimeter of the blade. A pivotable member is mounted within the head of the handle to support the blade and is biased to a retracted position with respect to the head of the handle. The blade is advanced to an operative position by an actuating lever pivotably mounted in the head. The actuating lever is biased to a retracted position by elastic bands located within the handle.

SUMMARY OF THE PRESENT INVENTION

The present invention provides a unitary actuator moving for a rotary cutter blade between a storage and an operative position with respect to a handle which includes a resilient section for biasing the blade to the storage position, a limit stop which holds the blade in a cutting position and a thumb actuated button for moving the blade to the actuating position.

The rotary cutter is also advantageously provided with a finger guard formed as an integral part of the handle.

A further feature of the invention is provided by a blade guard which is mounted on the blade to cover the upper quadrant of the blade in both the operative and inoperative positions of the blade.

Other principal features and advantages of the invention will become apparent to those skilled in the art upon review of the following drawings, the detailed description and the appended claims.

Figure 1:
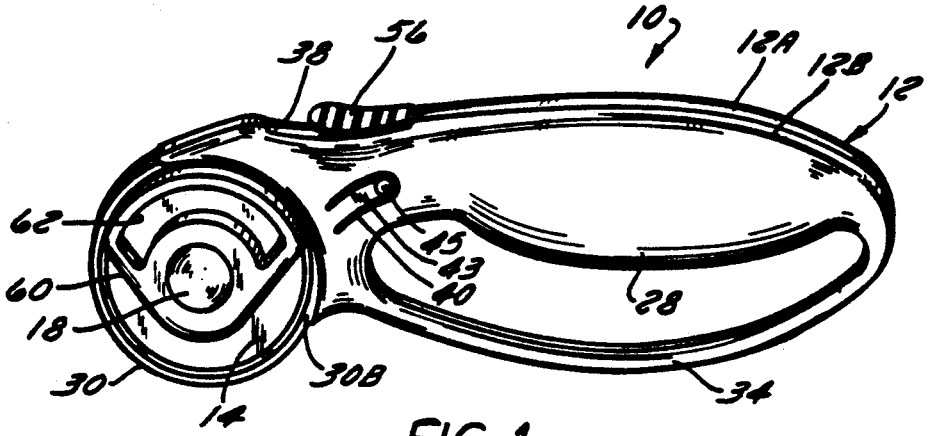
FIG. 1 is a perspective view of a hand held rotary cutter in accordance with the present invention.
Figure 5:
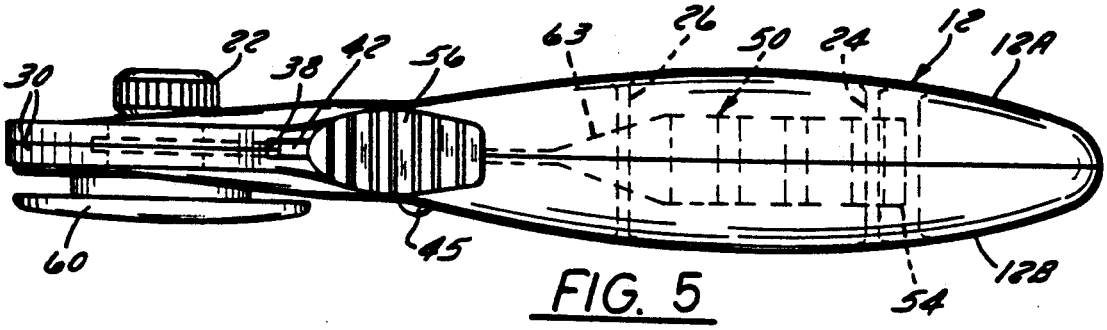
FIG. 5 is a top view of FIG. 2.
Figure 4:
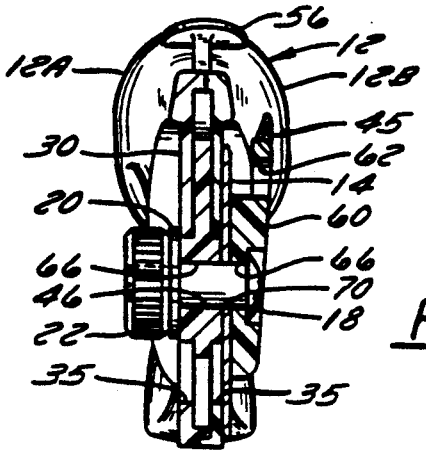
FIG. 4 is a end view taken on line 4—4 of FIG. 2 of the rotary cutter broken away to show the one piece actuator.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
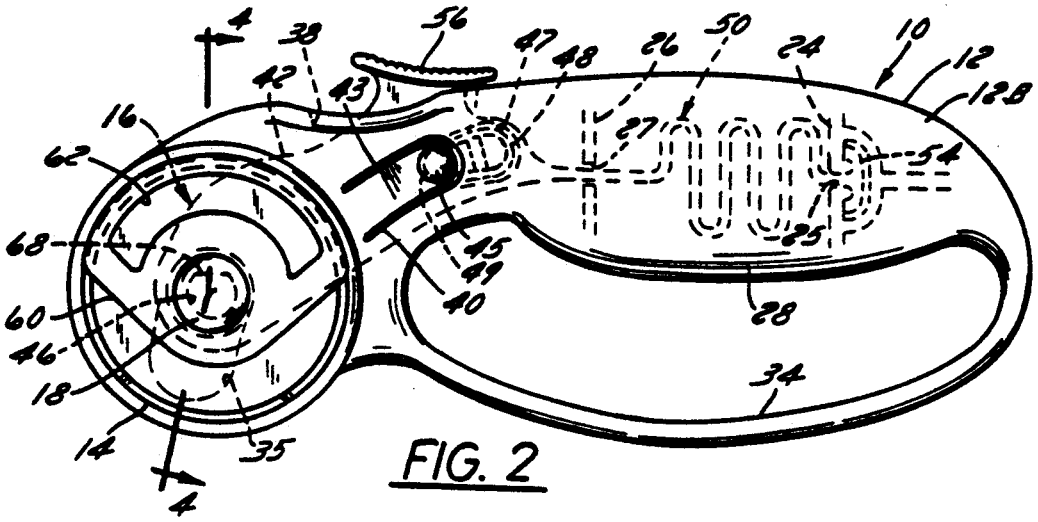
FIG. 2 is a left side elevational view of the rotary cutter with the cutter blade retracted.
Figure 3:
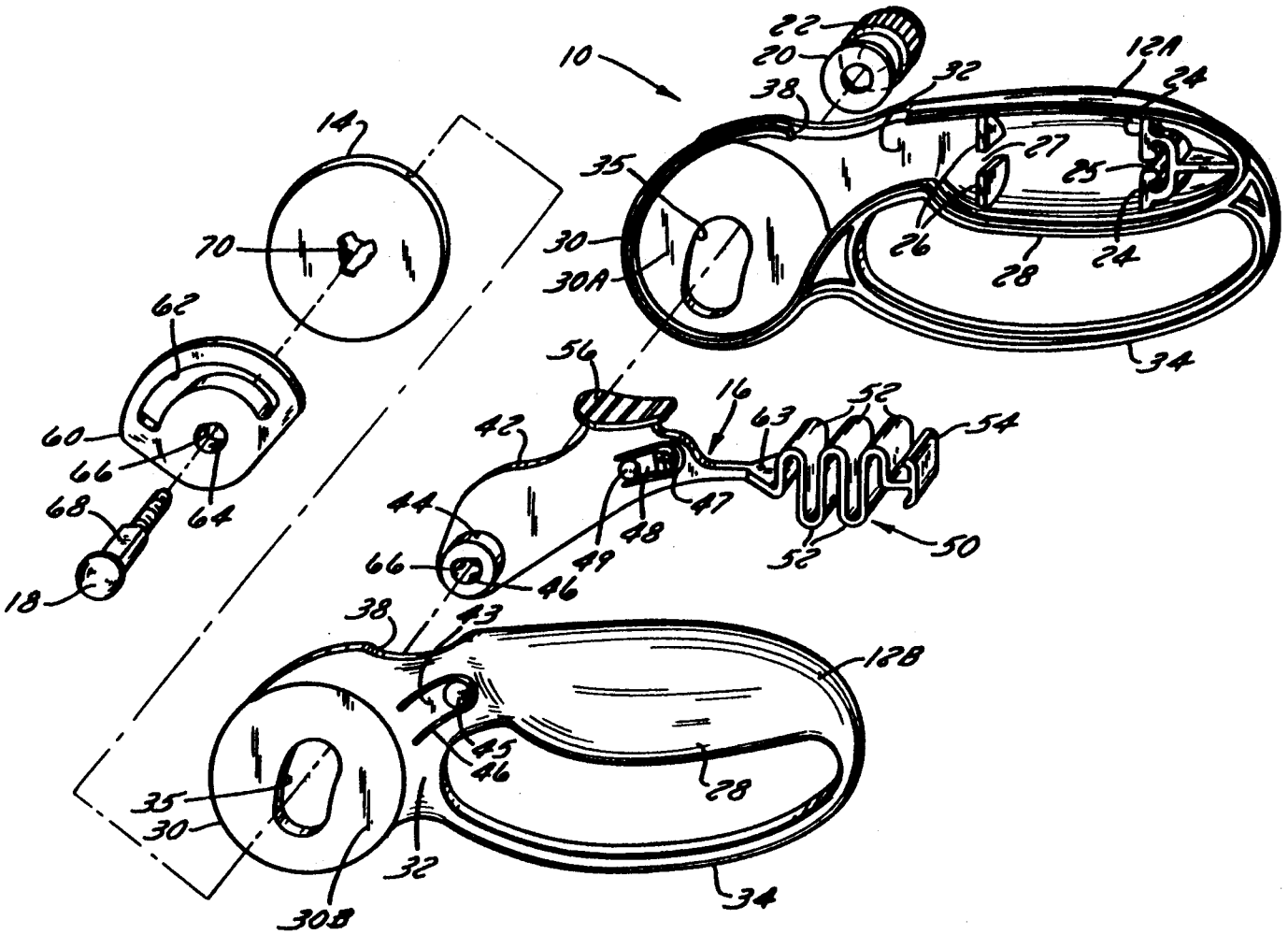
FIG. 3 is an exploded view of the rotary cutter shown in FIG. 2.

Referring to FIGS. 1, 2 and 3 a rotary cutter 10 is shown which includes a body 12, a disc-shaped blade 14 of a predetermined diameter, a blade actuator 16, a retainer bolt 18, a spring washer 20, and a retainer nut 22. The body 12, as shown in FIG. 3, is formed of symmetrical side walls 12A and 12B Which on assembly form an interior cavity therebetween. Each side wall includes a pair of partitions 24 on the inside of the back of the side wall and a pair of partitions 26 on the inside of the front of the side wall. Each pair of partitions forming a space 25, 27 between the edges of said partitions.

The body 12 includes a hand grip portion or handle 28 and a cylindrical head 30 interconnected by a neck 32, a finger guard 34 is provided along the length of the hand grip portion 28.

The body 12 when assembled includes a planar disc or platform having substantially flat side surfaces 30A and 30B. The side surfaces 30A and 30B are of a diameter greater than the diameter of the blade 14. An arcuate aperture 35 is provided in each of the side surfaces 30A and 30B extending transversely therethrough.

The neck 32 is provided with an opening 38 which is located in the top of the neck 32. The side wall 12B is provided with a "U" shaped slot 40 in the neck 32 which defines a resilient tab 43. An actuator button 45 is formed on the end of the tab 43.

The blade actuator 16 generally includes a main body portion 42 and a spring 50. The main body portion 42 includes a boss 44 on each side having a bolt opening 46, a U-shaped slot 47 forming a tab 48 and a means in the form of a buttom 56 for moving the actuator to the operative position. The bosses 44 are aligned with the opening 35 in the side surfaces 30A and 30B. A button 49 is formed on the tab 48 inwardly from the slot 47.

Figure 7:
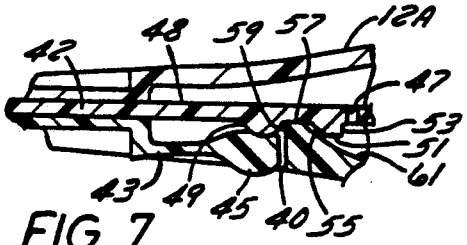
FIG. 7 is a cross sectional view of the snap lock assembly shown in the retracted position.
Figure 8:
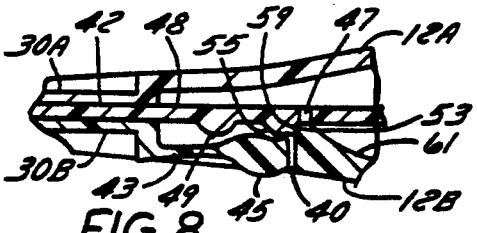
FIG. 8 is a view similar to FIG. 7 shown in the extended position.
Figure 6:
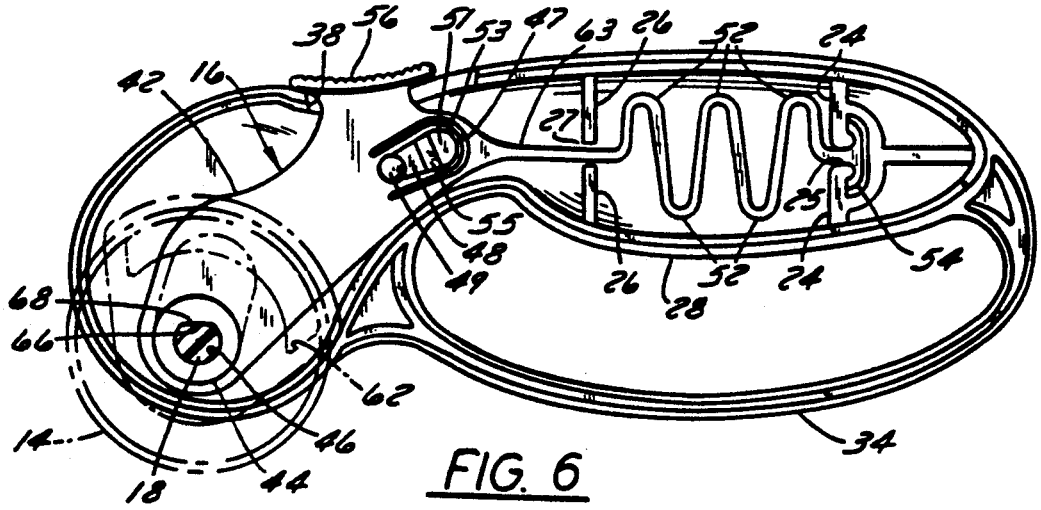
FIG. 6 is a side view of the rotary cutter with the left side removed.

Referring to FIGS. 7 and 8, a ridge 51 is shown formed on the end of the tab 48 which includes a flat surface 53 on one side and a sloped surface 55 on the other side of ridge 51. A corresponding ridge 57 is formed on the edge of slot 40 which includes a flat surface 59 and a sloped surface 61. When the actuator 16 is in the retracted position as shown in FIG. 7 the sloped surface 55 of ridge 51 will be located adjacent sloped surface 61 of ridge 57. When the actuator 16 is moved to the extended or operative position, the sloped surface 55 on ridge 51 will slide up the sloped surface 61 on ridge 57 forcing the tab 48 away from ridge 57. When the ridge 51 clears the ridge 57, the tab 48 will snap back aligning the flat surface 53 with the flat surface 59 as shown in FIG. 8, locking the actuator 16 in the operative or cutting position. The actuator is released by pressing the button 45 on tab 43 inward against button 49 and ridge 51. The spring formed by resilient section 50 will snap the actuator 16 rearwardly to the storage position.

The spring 50 is formed by a flat strip 63 of flexible material which in the folded position forms a series of loops 52. The strip 63 is aligned in the spaces 25 and 27. An anchor 54 is provided on the end of the strip 63 which matingly engages the edges of the partitions 24. The actuator 16 is moved between open and closed positions by means of a button 56 provided on the edge of the main section 42 which is aligned with the opening 38 in the neck 32. The blade 14 is moved tot he operative position by pushing the button 56 forward which elongates the spring 50.

The circular blade 14 is shown mounted on the boss 44 on planar surface 30B by means of the bolt 18 which passes through an opening 70 in circular blade 14. The spring washer 20 and retainer nut 22 are mounted on the bolt 18.

A blade guard 60 is provided on the top portion of the blade 14 to protect the operator from engaging the upper quarter section of the blade. In this regard and referring to FIG. 3 the safety guard 60 includes an arcuate opening 62 and a bolt hole 64. The bolt holes 46 and 64 each include a flat section 66. The retainer bolt 18 is also provided with a flat section 68 which matingly engages the flat section 66 in the blade guard and the bosses 44 to prevent the safety guard 60 from rotating with the blade 14.

Thus, it should be apparent that there has been provided in accordance with the present invention a rotary blade actuator for a hand held cutter that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A rotary cutter comprising a handle, a cylindrical head formed on one end of said handle, said head having an internal cavity and a planar surface on each side thereof, a unitary actuating member mounted in said cavity, a circular blade, means for securing said blade to said actuating member on one side of said planar surfaces, a button integrally formed on said actuating member for moving said blade to an operative position with a portion of said blade projecting outwardly from said cylindrical head, and a spring integrally and unitarily formed on said actuating member for biasing said blade to a storage position.

2. The rotary cutter according to claim 1 including first a ridge on said handle and a tab formed in said actuating member, said tab including a second ridge positioned to engage said first ridge to hold the actuating member in the operative position.

3. The rotary cutter according to claim 2 wherein said handle includes a tab positioned to engage said tab on said actuating member to release said first ridge from said second ridge.

4. The rotary cutter according to claim 3 including a blade guard and means mounted on said actuating member for supporting said guard in a position to cover a portion of the edge of the blade.

5. The rotary cutter according to claim 1 including a blade guard mounted on said actuating member to cover a portion of the circular blade.

6. The rotary cutter according to claim 5 including means for locking said actuating member in the operative position.

7. The rotary cutter according to claim 6 wherein said actuating member includes a resilient tab formed on said actuating member, said tab having a ridge on the end thereof, said handle including a ridge for matingly engaging the ridge on said resilient tab on said actuating member when said actuating member is moved to the operative position.

8. The rotary cutter according to claim 7 including a resilient tab formed on said handle for releasing said ridge on said tab on said actuating member from said ridge on the handle whereby said actuating member is retracted by said spring formed on the actuating member.

9. A hand held rotary cutter comprising a handle, a cylindrical head formed on one end of the handle and having a planar surface on one side, said handle and head having an internal cavity, a unitary actuating member mounted in said cavity, said actuating member including a spring formed unitarily and integrally therewith, a circular cutting blade mounted on said actuating member in alignment with said planar surface, said spring biasing said blade to a storage position with respect to said planar surface and means formed integrally with said actuating member for moving said actuating member to an operative position with a portion of said blade projecting outwardly from said planar surface.

10. The rotary cutter according to claim 9 including means mounted on said actuating member for covering a portion of the cutting edge of said blade.

11. The rotary cutter according to claim 10 including means on said handle for preventing contact with the exposed portion of the rotary blade.

* * * * *